US005393633A

United States Patent [19]

Furukawa et al.

[11] Patent Number: 5,393,633

[45] Date of Patent: Feb. 28, 1995

[54] LIQUID DEVELOPER FOR ELECTROSTATIC PHOTOGRAPHY

[75] Inventors: Akira Furukawa; Nobuko Nakazima, both of Tokyo, Japan

[73] Assignee: Mitsubishi Paper Mills Limited, Tokyo, Japan

[21] Appl. No.: 928,343

[22] Filed: Aug. 12, 1992

[30] Foreign Application Priority Data

| | | | |
|---|---|---|---|
| Aug. 15, 1991 | [JP] | Japan | 3-229564 |
| Aug. 15, 1991 | [JP] | Japan | 3-229569 |
| Aug. 15, 1991 | [JP] | Japan | 3-229570 |
| Jul. 6, 1992 | [JP] | Japan | 4-178552 |

[51] Int. Cl.[6] ..... G03G 9/13

[52] U.S. Cl. ..... 430/114; 430/115; 430/137; 430/904

[58] Field of Search ..... 430/114, 137, 904, 115

[56] References Cited

U.S. PATENT DOCUMENTS

| | | | |
|---|---|---|---|
| 3,900,412 | 8/1975 | Kosel | 252/62.1 |
| 5,006,441 | 4/1991 | Kato | 430/114 |
| 5,114,822 | 5/1992 | Kato et al. | 430/114 |
| 5,190,989 | 3/1993 | Himori | 522/57 |

FOREIGN PATENT DOCUMENTS 1-282566 11/1989 Japan .

OTHER PUBLICATIONS

Otsu et al., "Living Radical Polymerzation in Homogeneous System by Using Iniferter: Design of Block Copolymers", J. Macromol. Sci. Chem., A21 (8&9), pp. 961–977 (1984).

*Primary Examiner*—Marion E. McCamish
*Assistant Examiner*—Mark A. Chapman
*Attorney, Agent, or Firm*—Cushman, Darby & Cushman

[57] ABSTRACT

Provided is a liquid developer for electrostatic photography comprising resin particles dispersed in a highly insulating hydrocarbon medium wherein said resin particles are prepared by polymerizing a monomer which is soluble in the medium and becomes insoluble therein upon polymerization in the presence of a polymer which is soluble in the medium and has a chain transferable group at its terminal or on its side chain, thereby to form resin particles stably dispersed in the medium.

15 Claims, No Drawings

LIQUID DEVELOPER FOR ELECTROSTATIC PHOTOGRAPHY

BACKGROUND OF THE INVENTION

The present invention relates to a liquid developer used for development of electrostatic latent images in electrophotography and electrostatic recording and more particularly it relates to a liquid developer which has improved storage life, stability and fixability and is prevented from sticking of the toner to inside and outside of the developing apparatus during long-term using and thus is improved in its maintenance.

A large number of liquid developers for electrostatic photography have already been known. The most popular are those which are prepared by mechanically dispersing color pigments or dyes such as carbon black, cyanine blue, nigrosine and oil dyes in highly insulating media together with resins such as rosins, alkyd resins, acrylic resins and synthetic rubbers by a ball mill, an attritor, a homogenizer or the like and adding thereto metallic soaps, amines, higher fatty acids or the like to give an electric charge to the dispersed particles of the dispersion.

However, the liquid developers obtained by the above process suffer from the problems that particle size distribution of the dispersed particles per se is broad and precipitates are produced due to sedimentation of coarse particles and that dispersion stability of the dispersed particles is not enough and agglomeration and precipitation of the particles occur with elapse of time and so, stable images can be obtained with difficulty in long-term use.

As mentioned in Japanese Patent Kokoku Nos. 53-54029 and 57-12985, there are processes for preparation of liquid developers according to which a polymerizable vinyl group is previously introduced into a precursor polymer by a polymer reaction and a monomer is polymerized in the presence of the said precursor polymer to produce a graft copolymer which stabilizes the dispersed polymers thereby to realize polymer particles superior in dispersion stability and the resulting polymer particles are colored with dyes.

These processes have problems in control of introduction of the vinyl group and in reproducibility and formation of gel is often brought about or sometimes the dispersed particles cannot be produced stably. Thus, there occurs a problem when dispersed particles uniform in particle size distribution are to be stably produced.

Furthermore, Japanese Patent Kokai (Laid-Open) Nos. 59-86174, 59-177572, 59-212850, 59-212851, 60-164757, 60-179751, 60-185962, 60-185963, 60-252367, 61-116364 and 61-116365 disclose that in the presence of a polymer soluble in a highly insulating medium, a monomer which is soluble in said medium, but becomes insoluble when polymerized is polymerized and the resulting resin dispersion is used as a liquid developer.

Although the liquid toners obtained by the above processes are superior in stability in industrial production and dispersion stability, when they are actually used as liquid toners, redispersibility of the dispersed particles in the medium is not enough and the dispersed particles after evaporation of the medium are in the form of a film and cannot be readily removed and as a result, the film sticks to inside and outside of the developing apparatus. Therefore, the apparatus per se is considerably contaminated and especially, the toner film which stick to the rolls in the developing part causes insufficient squeezing by the rolls. Accordingly, maintenance of the developing apparatus is always needed to inhibit generation of these troubles.

SUMMARY OF THE INVENTION

The object of the present invention is to provide a stable liquid developer which can form stable images even when it has been used for a long time and which makes the maintenance substantially unnecessary or considerably diminishes the maintenance. That is, unless particle size of the dispersed particles as liquid developers is uniform, deterioration in image quality caused by precipitation of the particles occurs with elapse of time and such liquid developers cannot be those which can give stable images even after use of long-term and which are aimed at by the present invention. Furthermore, unless redispersibility of the particles in the medium is superior, a sticking film of the resin particles is formed by evaporation of the medium and the developing part of the apparatus is much stained and thus, maintenance is always required.

The present invention provides a liquid developer for electrostatic photography comprising a highly insulating hydrocarbon medium which contains at least resin particles dispersed therein, characterized in that said resin is one which is obtained by polymerizing at least the following monomer (A) in the presence of the following polymer (S).

Polymer (S): A polymer which is soluble in said medium and has a chain transferable group at its terminal(s) or on its side chain.

Monomer (A): A monomer which is soluble in said medium and becomes insoluble therein when polymerized.

DESCRIPTION OF THE INVENTION

The above chain transferable group means a functional group having a chain transfer constant to polymerization radical which is not zero in polymerization of the monomer (A). Preferred examples are polymers having a functional group represented by the following formula (1) at the terminal(s) or on the side chain of the polymers. However, the present invention is not limited to these specific functional groups. For example, as mentioned in T. Ohtsu and A. Kuriyama, "Polymer Bull.", (Berlin), 11, 135 (1984), a polymer having a dithiocarbamate group at one or both terminals is obtained by heating a corresponding thiuram represented by the formula (2) together with a monomer in a nitrogen atmosphere or by heating a compound represented by the formula (2) together with various polymerization initiators.

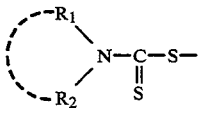

(1)

wherein $R_1$ represents an alkyl group of 1 to 8 carbon atoms, $R_2$ represents a hydrogen atom or an alkyl group of 1 to 8 carbon atoms, $R_1$ and $R_2$ may be identical or different and furthermore, $R_1$ and $R_2$ may link to each other to form an alkylene group of 3 to 8 carbon atoms and to form a ring together with N.

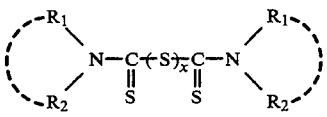

(2)

wherein $R_1$ and $R_2$ have the same meanings as defined in the formula (1) and x represents an integer of 1 to 4.

Typical examples of the compounds represented by the formula (2) are tetramethylthiuram disulfide, tetraethylthiuram disulfide, tetrabutylthiuram disulfide and dipentamethylene tetrasulfide. In addition to these compounds represented by the formula (2), there may also be similarly used the compounds in which two dithiocarbamate groups are linked through a p-xylylene group such as p-xylylene bis-N,N-dialkyldithiocarbamates or various dithioates though the number of the terminal dithiocarbamate group introduced somewhat reduces.

In order to obtain the resin (S) soluble in the medium by the above-mentioned process, it is preferred to polymerize the monomer represented by the formula (3) or (4) together with the compound represented by the formula (2). Alternatively, there may be used copolymers comprising the monomers represented by the formulas (3) and (4) or resins prepared by copolymerizing with further various monomers.

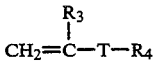

(3)

wherein $R_3$ represents a hydrogen atom or a methyl group, $R_4$ represents an alkyl group of 8 to 30 carbon atoms and the linking group T represents —COO— group or —CONH— group.

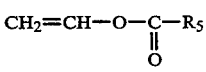

(4)

wherein $R_5$ represents an alkyl group of 8 to 30 carbon atoms.

When the above-mentioned monomer is added to the polymer (S) obtained by the above processes using the monomers and the mixture is irradiated with light, the dithiocarbamate group present at the terminal of the polymer (S) is photolyzed and polymerization of the monomer is initiated from the generated terminal radical of the polymer to form a block copolymer containing the polymer (S) as a component. Alternatively, when various monomers are polymerized in the presence of the polymer (S) together with a polymerization initiator, terminal radicals of the polymer (S) are also generated similarly by the attack with other radicals because the dithiocarbamate group present at the terminal of the polymer (S) has chain transferability, thereby to form a similar block copolymer.

In this case, the monomers which are polymerized in the presence of the polymer (S) have no limitation, but especially when the monomer (A) which is soluble in the medium and becomes insoluble when polymerized is used, a block copolymer of polymer (A) containing the polymer (S) as a component is produced by the polymerization and this block copolymer acts as a dispersion stabilizer effective for stabilization of the dispersed particles.

For example, when the monomer (A) is polymerized in a medium in which the polymer (S) has been dissolved, a block copolymer with the polymer (S) is produced at the initial stage of the polymerization and when the monomer (A) is further fed, particles of polymer (A) which has become insoluble in the medium are formed in such state as stabilized by said block copolymer.

As examples of another soluble polymer (S), mention may be made of polymers which have a mercapto group at one terminal thereof. As disclosed in Japanese Patent Kokai (Laid-Open) No. 3-41109, the polymer having the mercapto group at only one terminal is obtained by treating with ammonia or an amine a polymer obtained by polymerization of a vinyl monomer using thiolic acid as a chain transfer agent.

The polymer (S) soluble in a highly insulating medium and having a mercapto group at one terminal thereof which is used in the present invention can be obtained, for example, by polymerizing the monomer represented by the formula (3) or (4) in the presence of thiolic acid. Alternatively, there may be used copolymers comprising the monomers represented by the formulas (3) and (4) or these copolymers which are further copolymerized with other various monomers as far as these monomers do not damage the solubility of the resulting polymers in the medium.

The polymer (S) which is soluble in the medium and has a mercapto group at one terminal thereof is obtained by polymerizing the above-mentioned monomer with a suitable polymerization initiator in the presence of thiolic acid and treating the resulting polymer with ammonia or an amine under moderate conditions.

The thiolic acid here includes compounds having —COSH group and examples are thiolacetic acid, thiolpropionic acid and thiolbutyric acid. Thiolacetic acid is especially preferred because hydrolyzability of thiolic acid ester at the terminal of the resulting polymer is high.

When polymerization of various monomers is carried out in the presence of the polymer (S) in this way, the mercapto group of the polymer (S) acts as an effective chain transfer agent and thus a block copolymer containing the polymer (S) as one component is easily produced. Since the mercapto group shows a high chain transfer constant for various monomers in any cases, the desired block copolymers can be easily produced without limiting the monomers.

When especially the monomer (A) which is soluble in the medium and becomes insoluble when polymerized is used as the monomer polymerized in the presence of the polymer (S), a block copolymer with polymer (A) containing the polymer (S) as a component is produced by the polymerization and this has the action to effectively disperse and stabilize the precipitated polymer (A) in the form of fine particles.

For example, when the monomer (A) is polymerized in a medium in which the polymer (S) has been dissolved, a block copolymer with the polymer (S) is produced at the initial stage of the polymerization and when the monomer (A) is further fed, particles of polymer (A) which has become insoluble in the medium are formed in such state as stabilized by said block copolymer.

As examples of the soluble polymers having chain transferable group(s) other than those having at one terminal or both terminals mentioned above, naturally polymers having the similar chain transferable group on side chain can be used. These polymers can be obtained, for example, by previously preparing the monomer represented by the formula (5) or (6) and then preparing a copolymer of said monomer with the monomer represented by the formula (3) or (4). In order that the resulting polymer has good solubility in the hydrocarbon medium used, the monomer represented by the formula (5) or (6) is used preferably in an amount of 20% by weight or less of the monomer represented by the formula (3) or (4). Furthermore, it is practically and economically preferred to use it in the range of 1 to 10% by weight.

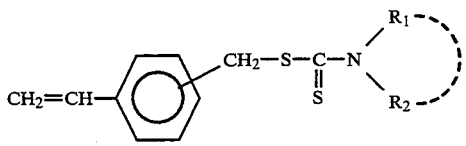

(5)

wherein $R_1$ and $R_2$ have the same meanings as defined in the formula (1).

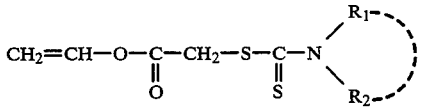

(6)

wherein $R_1$ and $R_2$ have the same meanings as defined in the formula (1).

In spite of the examples mentioned above, for feeding of the monomer (A) in such polymerization process, the whole amount of the monomer (A) may be polymerized at one time together with the polymer (S) or only a part of the monomer (A) may be previously polymerized in the presence of the polymer (S) and then, the remainder of the monomer (A) may be fed by dropping or other means. According to the latter process, using a part of the monomer (A), a block or graft copolymer thereof with the polymer (S) is prepared and simultaneously using as a seed the produced stable dispersion of polymer (A) in the form of fine particles, so-called seed polymerization is carried out by polymerizing a monomer with the polymer (A) whereby it becomes possible to control particle size of the resulting particles and make the particle size more uniform.

The polymerization initiators used in the present invention are not limitative as far as they are soluble in the monomer or polymerization medium used. However, when concentration of the monomer used is high or when polymerization rate is high, control of temperature becomes difficult owing to the heat generated with progress of the polymerization and sometimes dangerous state is brought about by bumping of the monomer. Furthermore, in such unsteady polymerization, it has sometimes occurred that particle size distribution in the resulting polymer dispersion is extremely broad or agglomeration is generated. These are serious problems especially when the dispersion is produced in industrial scale.

Therefore, how to carry out the polymerization steadily and stably is important for production of a dispersion of uniform particle size and free from agglomeration and this means that proper selection of polymerization temperature and initiators is essential. According to the present invention, it has been found that when the polymerization initiating temperature is set at 70° C. or lower and an oil-soluble initiator having a decomposition half-value period of 2 hours or less at 70° C. is used as the initiator, an abrupt polymerization can be inhibited, the polymerization proceeds steadily and stably and thus, dispersed particles of uniform particle size distribution can be obtained. If the decomposition half-value period of the polymerization initiator is more than 2 hours, particles are produced through the whole polymerization period, resulting in distribution in particle size while when the decomposition half-value period is 2 hours or less at that temperature, formation of particle nuclei rapidly proceeds at the initial stage of the polymerization and therefore, fine particles of very uniform particle size can be obtained. Furthermore, the polymerization initiating temperature is preferably 70° C. or lower and if polymerization is initiated at higher than 70° C., the polymerization proceeds with increasing speed due to generation of polymerization heat and control of the reaction becomes very difficult. When the polymerization temperature is too low, a long time is required for completion of the polymerization and the preferred temperature range is 50° to 70° C. Examples of the preferred initiators are 2,2'-azobis(4-methoxy-2,4-dimethylvaleronitrile) (V-70; manufactured by Wako Junyaku Co.), 2,2'-azobis(2-cyclopropylpropionitrile) (V-68; manufactured by Wako Junyaku Co.) and 2,2'-azobis(2,4-dimethylvaleronitrile) (V-65; manufactured by Wako Junyaku Co.).

The molecular weight of the polymer (S) is preferably 1000 to 500,000. If the molecular weight is less than 1000, the effect to disperse and stabilize the particles hardly appears and if it is more than 500,000, concentration of the chain transferable terminal group is too low and viscosity of the resulting fine particle dispersion increases and thus this is not preferred.

The monomer (A) used in the present invention is not limitative as far as it is soluble in the medium in the state of monomer and becomes insoluble in the medium when it is polymerized. As preferred examples, mention may be made of vinyl esters of aliphatic carboxylic acids of 1 to 6 carbon atoms, such as vinyl acetate, vinyl propionate and vinyl chloroacetate, vinyl benzoate, acrylic acid, methacrylic acid, crotonic acid, maleic acid, itaconic acid and their alkyl esters of 1 to 6 carbon atoms or amides, ethylene glycol di(meth)acrylates, methylenebisacrylamide, styrene and their derivatives, divinylbenzene, and N-containing vinyl monomers such as N-vinyl-2-pyrrolidone, N-vinylpyridine, N-vinylimidazole and N,N-dialkylaminoethyl (meth)acrylates.

As a monomer other than the monomer (A) to be polymerized in the presence of the polymer (S), a monomer component (B) which is soluble in the medium in the state of monomer and which provides a soluble polymer after polymerized can be used together with the monomer (A). In this case, the dispersion stability of the resulting particles can be further enhanced by the substituent from the monomer component (B) which appears on the surface of the particles.

Examples of the monomer (B) are (meth)acrylic acid esters, (meth)acrylic acid amides, vinyl esters and vinyl ethers. The amount of the monomer (B) based on the monomer (A) is 10% by weight or less and if the amount is more than 10% by weight, solubility of the particles per se increases and thus, sometimes stable particles can be formed with difficulty.

The amount of the polymer (S) based on the total amount of the monomers (A) and (B) is preferably 0.2% by weight or more. If the amount is less than 0.2% by weight, stable particles cannot be formed. When the amount is more than 30% by weight, stable particles can also be formed, but in this case a large amount of the resin for dispersion stabilization is present on the surface of the particles or in the liberated form and use of such soluble resin in a large amount as a liquid developer results in accumulation of the soluble resin which does not participate in formation of visible images and a sticking film of the soluble resin is formed after evaporation of liquid. This is not desirable. Thus, it is preferred to use the polymer (S) in an amount of at most 30% by weight based on the total amount of the monomers (A) and (B). Especially when the polymer (S) is used in an amount of about 2 to 15% by weight based on the total amount of the other monomers, the particles having the most favorable redispersibility with no formation of sticking film can be obtained. It is one of the advantageous effects of the present invention that the stable particles can be formed with use of such a small amount of the resin for dispersion stabilization.

Since the resin particles obtained in the present invention have on their surface the resin for dispersion stabilization comprising a block or graft copolymer, they are markedly excellent in dispersion stability and further in redispersibility. Therefore, even when the particles are dried by evaporation of the medium, they are readily redispersed in the medium and hence, when such resin dispersion is used for liquid developers, good liquid developers which cause formation of no sticking film even after long-term use and need no or substantially no maintenance can be obtained.

As examples of the highly insulating hydrocarbon media used in the present invention, mention may be made of normal paraffinic hydrocarbons, isoparaffinic hydrocarbons, alicyclic hydrocarbons and halogenated aliphatic hydrocarbons. From the points of safety and volatility, practically preferred are Shell Sol 71 (manufactured by Shell Oil Co.), Isopar O, Isopar H, Isopar K, Isopar L and Isopar G (Exxon Co., Ltd.) and IP Solvent (manufactured by Idemitsu Petrochemical Co.) which are isoparaffinic hydrocarbons.

For using the resin dispersion obtained in the present invention as a liquid developer, the dispersed resin particles can be colored and imparted with an electric charge. As colorants for the dispersed resin particles, there may be optionally used those which are generally known as colorants for liquid developers and preferred are oil soluble dyes such as oil black and oil red and organic pigments such as carbon black and phthalocyanine.

Coloration of the dispersed particles can be easily attained by mixing a liquid in which a colorant is dissolved or dispersed by optional methods with a liquid containing dispersed resin particles or dropping the former to the latter.

The charge control agents used for giving electric charge to the dispersed resin particles include, for example, copper oleate, cobalt naphthenate, lecithin, sodium dioctylsulfosuccinate and aluminum abiatate. Furthermore, there may also be used the charge control agents which are described in Japanese Patent Kokoku Nos. 49-26594 and 49-26595, Japanese Patent Kokai (Laid-Open) Nos. 60-173558, 60-175060, 60-179750, 60-182447, 60-218662 and 62-30260.

The liquid developers obtained in the present invention can also be used for making the lithographic printing plates disclosed in Japanese Patent Kokai (Laid-Open) Nos. 61-67869 and 61-149399. When the liquid developers are used for making these lithographic printing plates, they must have resist property against alkali solutions and they can provide especially superior printing plates when inorganic alkali solutions are used as decoating solutions.

The present invention will be explained in more detail by the following nonlimiting examples.

PREPARATION EXAMPLE 1

Preparation of a Polymer for Dispersion Stabilization

A solution prepared by dissolving 300 g of n-dodecyl methacrylate and 6 g of tetraethylthiuram disulfide in 100 g of IP Solvent (manufactured by Idemitsu Petrochemical Co.) was charged in a 1 liter four-necked flask equipped with a stirrer, a thermometer, a nitrogen introduction pipe and a reflux-condenser and stirred at 100° C. for 24 hours. Then, the whole solution was added to 2 liters of methanol and the precipitated polymer was separated by decantation and sufficiently repeatedly washed with methanol. The molecular weight of the resulting polymer was measured. Thus, there was obtained a polymer for dispersion stabilization which had a number-average molecular weight of 6500 and had dithiocarbamate groups at its both terminals.

The number-average molecular weight was obtained by GPC-LALLS (low angle laser light scattering). Furthermore, concentration of the dithiocarbamate group present at terminal of the polymer was obtained by UV measurement (285 nm) and the above number-average molecular weight was compared with number-average polecular weight based on the UV measurement, whereby the number of dithiocarbamate group present at the terminal of the polymer was obtained.

PREPARATION EXAMPLE 2

Preparation of a Polymer for Dispersion Stabilization

Polymerization was carried out in the same manner as in Preparation Example 1 except that 2-ethylhexyl methacrylate was used in place of n-dodecyl methacrylate and purification was similarly carried out to obtain a polymer for dispersion stabilization which had a number-average molecular weight of 7000 and had two dithiocarbamate groups at both terminals per one molecule.

PREPARATION EXAMPLE 3

Preparation of a Polymer for Dispersion Stabilization

In the same manner as in Preparation Example 1, to a solution prepared by dissolving 300 g of stearyl methacrylate and 7.5 g of tetramethylthiuram disulfide in 150 g of xylene and 50 g of isopropanol was added 3 g of 2,2'-azobis(4-cyanovaleric acid) at 70° C., followed by stirring for 8 hours. Thereafter, the whole of the content was added to 2 liters of methanol and the precipitate was filtered and purified. There was obtained a polymer for dispersion stabilization which had a number-average molecular weight of 10,000 and which had 1.5 dithiocarbamate group at the terminal per one molecule.

PREPARATION EXAMPLE 4

Preparation of a Polymer for Dispersion Stabilization

In the same manner as in Preparation Example 3, 7.5 g of tetraethylthiuram disulfide and 3.0 g of azobisisobutyronitrile (AIBN) were added to a solution prepared by dissolving 270 g of n-dodecyl methacrylate and 30 g of vinyl acetate in 100 g of xylene, followed by stirring at 70° C. for 9 hours. The purification was similarly carried out to obtain a polymer for dispersion stabilization which had about 1.4 dithiocarbamate group at terminal per one molecule.

PREPARATION EXAMPLE 5

Preparation of a Polymer for Dispersion Stabilization

In the same manner as in Preparation Example 4, 8 g of tetramethylthiuram disulfide and 3 g of azobisisobutyronitrile were added to a solution prepared by dissolving 290 g of 2-ethylhexyl acrylate and 10 g of methacrylic acid in 150 g of xylene and 50 g of isopropanol, followed by stirring at 70° C. for 8 hours. The purification was similarly carried out to obtain a polymer for dispersion stabilization which had about 1.3 dithiocarbamate group at the terminal per one molecule.

PREPARATION EXAMPLE 6

Preparation of a Polymer for Dispersion Stabilization

A solution prepared by dissolving 300 g of n-dodecyl methacrylate, 3 g of AIBN and 6 g of thiolacetic acid in 100 g of dioxane was charged in a 1 liter four-necked flask equipped with a stirrer, a thermometer, a nitrogen introduction pipe and a reflux condenser and stirred at 70° C. for 24 hours. Thereafter, 20 g of 25% aqueous ammonia was added thereto, followed by stirring at 30° C. for 1 hour. Then, the whole of the content was added to 2 liters of methanol and the precipitated polymer was separated by decantation and sufficiently washed with methanol. A polymer for dispersion stabilization having a mercapto group at one terminal was obtained in a yield of 68%. The average molecular weight of the polymer was about 6000.

PREPARATION EXAMPLE 7

Preparation of a Polymer for Dispersion Stabilization

In the same manner as in Preparation Example 6, to a solution prepared by dissolving 280 g of stearyl methacrylate, 20 g of methyl acrylate and 2 g of thiolacetic acid in 150 g of xylene and 50 g of isopropanol was added 3 g of 2,2'-azobis(4-cyanovaleric acid) at 70° C. and then 6 g of thiolacetic acid was dropped from a dropping funnel over a period of 5 hours to carry out polymerization. Thereafter, 25% aqueous ammonia was added thereto, followed by stirring at room temperature for 2 hours. Then, the whole of the content was added to 2 liters of methanol and the resulting precipitate was filtered and purified to obtain a polymer for dispersion stabilization having a mercapto group at one terminal.

PREPARATION EXAMPLE 8

Preparation of a Polymer for Dispersion Stabilization

Five grams of a monomer represented by the formula (5) and prepared from commercially available chloromethylstyrene (mixture of p- and m-isomers) and sodium diethyldithiocarbamate and 95 g of dodecyl methacrylate were dissolved in 100 g of IP Solvent (IP-1620 manufactured by Idemitsu Petrochemical Co.) and to the solution was added 1 g of AIBN at 70° C. and polymerization was carried out for 5 hours to obtain a polymer for dispersion stabilization which had a chain transferable group on a side chain. This polymer had a weight-average molecular weight of about 50,000 measured by GPC.

COMPARATIVE PREPARATION EXAMPLES 1 TO 5

Preparation of Comparative Polymer for Dispersion Stabilization

Comparative polymers 1 to 5 for dispersion stabilization were prepared in the same manner as in Preparation Examples 1 to 5 except that AIBN was used as a polymerization initiator in all the examples without using the tetraalkylthiuram disulfide.

COMPARATIVE PREPARATION EXAMPLES 6 AND 7

Preparation of Comparative Polymer for Dispersion Stabilization

Comparative polymers 6 and 7 for dispersion stabilization were prepared in the same manner as in Preparation Examples 6 and 7 except that thiolacetic acid was not used and the polymerization was carried out with AIBN and besides the polymer was precipitated in methanol without treating it with aqueous ammonia.

PREPARATION EXAMPLES 9 TO 23

Preparation of Dispersed Resin Particles

Polymerization was carried out with the following formulation using the polymers for dispersion stabilization obtained in Preparation Examples 1 to 8 and Comparative Preparation Examples 1 to 7. Particle size of the resulting resin particles was measured by a scanning electron microscope.

| | |
|---|---|
| The polymer for dispersion stabilization | 7 parts |
| Vinyl acetate | 100 parts |
| IP Solvent | 250 parts |
| V-65 (manufactured by Wako Junyaku Co.) | 1 part |

Stirring was carried out at 60° C. for 4 hours. In all cases, the polymerization proceeded stably and the polymerization temperature rose to about 70° C. at maximum.

The results are shown in Table 1.

TABLE 1

| Preparation Example | Polymer for dispersion stabilization | Particle size of produced particles (nm) |
|---|---|---|
| 9 | Preparation Example 1 | 100–300 |
| 10 | Preparation Example 2 | 200–380 |
| 11 | Preparation Example 3 | 150–300 |
| 12 | Preparation Example 4 | 200–300 |
| 13 | Preparation Example 5 | 200–350 |
| 14 | Preparation Example 6 | 250–330 |
| 15 | Preparation Example 7 | 200–300 |
| 16 | Preparation Example 8 | 190–200 |
| 17–23 | Comparative Preparation Examples 1–7 | A large amount of agglomeration occurred. |

PREPARATION EXAMPLE 24

Preparation of Dispersed Resin Particles

To 10 g of the polymer for dispersion stabilization obtained in Preparation Example 1 were added 90 g of vinyl acetate, 5 g of N-vinylpyrrolidone, 5 g of vinyl benzoate, 1 g of V-65 and 250 g of IP Solvent, followed by stirring at 60° C. for 4 hours. As a result, a stably dispersed resin dispersion with no occurrence of agglomeration was obtained. The dispersion comprised monodispersed particles having a particle size of 200 nm. Abrupt generation of heat was not seen during the polymerization and the polymerization steadily proceeded at a temperature between 60° C. and 70° C.

PREPARATION EXAMPLE 25

Preparation of Dispersed Resin Particles

To 10 g of the polymer for dispersion stabilization obtained in Preparation Example 8 were added 90 g of vinyl acetate, 5 g of methyl acrylate, 5 g of vinyl hexanoate, 1.5 g of V-65 and 200 g of IP Solvent, followed by heating to 65° C. to obtain a stably dispersed resin dispersion with no occurrence of agglomeration. The dispersion comprised nearly monodispersed particles having a particle size of 210 nm.

EXAMPLE 1

Each of the resin dispersions obtained in Preparation Examples 9–16 and 24 and25 was weighed so that it had a solid content of 60 g. Thereto was dropped a solution prepared by dissolving 5 g of Oil Black HB (manufactured by Orient Chemical Co.) in 40 g of xylene under application of ultrasonic wave to dye the dispersed resin particles. Then, to the dispersion was added 8 g of a 1% solution prepared by dissolving aluminum abietate as a charge control agent in xylene and this was diluted with 10 liters of Isopar G to obtain a positively charged liquid developer. Plate making was carried out using the resultant liquid developer by EP-12 (zinc oxide master plate making machine manufactured by Mitsubishi Paper Mills Ltd.) to obtain clear images with no fog. Furthermore, continuous plate making was conducted for more than 1 month to obtain stable images with little stain of the developing part and with little sticking of the resin which might occur due to evaporation of the developer. Moreover, any stain caused by the dyed resin particles due to some evaporation of the developer was readily redispersed with Isopar G and there occurred substantially no troubles caused by sticking of resin.

COMPARATIVE EXAMPLE 1

The resin dispersion obtained in Comparative Preparation Example 6 was filtered with a nylon fabric of 200 meshes to remove agglomerations and then was weighed so that it had a solid content of 50 g. The resin dispersion was colored in the same manner as in Example 1 and the charge control agent was added thereto and the dispersion was diluted with 10 liters of Isopar G to obtain a comparative liquid developer. Similarly, using this developer a continuous plate making was carried out by EP-12 plate making machine for 1 month. The density of the resulting images was very low and besides, much sticking film of the dyed resin occurred at the developing part and this film was not redispersed by the solvent such as Isopar G and cleaning of the developing part was very difficult.

EXAMPLE 2

A dispersion of ϵ-copper phthalocyanine pigment in an acrylic resin of a high acid value was coated on an aluminum sheet subjected to hydrophilization treatment and dried to obtain a printing original plate (binder/pigment=75/25). This plate was positively charged in the dark by corona charging and then was exposed imagewise. Development was carried out with the respective liquid developers prepared in Example 1 and clear images with no fog were obtained with all of these liquid developers. The non-image portions were decoated (dissolved away) with DP-4 (developer for PS plate manufactured by Fuji Photo Film Co., Ltd.) which was diluted ten-fold with water. As a result, only the toner image portions remained as beautiful images and thus, printing plates were obtained. The resulting printing plates had a high printing endurance of more than 100,000 prints and gave no stain in the background area of the prints.

According to the present invention, a stably dispersed resin dispersion can be obtained in a high concentration and besides, when a liquid dispersion comprising this resin dispersion is used, stable images can be obtained over a long period of time because redispersibility of the particles is superior and there occurs no sticking of the resin due to evaporation even after long-term use of developing machines. Furthermore, the liquid developer is used for making printing plates, oleophilic images having high printing endurance can be produced.

What is claimed is:

1. A process for producing a liquid developer for electrostatic photography which includes a highly insulating hydrocarbon medium and particles of a resin dispersed in said medium, wherein said resin is obtained by the following steps:

polymerizing at least the following monomer (A) in the presence of the following polymer (S) by initiating the polymerization with a polymerization initiator:

polymer (S)—a polymer which is for stably dispersing the resin particles formed by polymerization of monomer (A) in such a state that the polymer bonds to the resin particles and which is soluble in said medium and has a dithiocarbamate group represented by the following formula (1) or a mercapto group at the terminal or on the side chain thereof

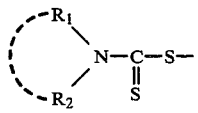

(1)

wherein $R_1$ represents an alkyl group of 1 to 8 carbon atoms, $R_2$ represents a hydrogen atom or an alkyl group of 1 to 8 carbon atoms, $R_1$ and $R_2$ may be identical or different and $R_1$ and $R_2$ may link to each other to form an alkylene group of 3 to 8 carbon atoms to form a ring together with N; and monomer (A)—a monomer which is soluble in said medium and becomes insoluble when polymerized by reaction at the chain transferable group part of the polymer (S) to become resin particles.

2. A process for producing a liquid developer according to claim 1, wherein the polymer (S) having a dithiocarbamate group at its terminal is prepared by polymerizing a monomer together with a compound represented by the following formula (2):

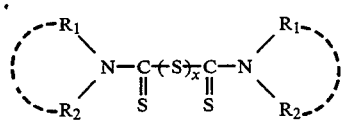

(2)

wherein $R_1$ and $R_2$ have the same meanings as defined in the formula (1) and x is an integer of 1–4.

3. A process for producing a liquid developer according to claim 2, wherein the polymer (S) having a dithiocarbamate group is prepared by polymerizing a monomer represented by the following formula (3) or (4) or copolymerizing the monomers represented by the formula (3) and (4) together with the compound represented by the above formula (2),

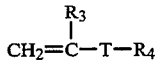

(3)

wherein $R_3$ represents a hydrogen atom or a methyl group, $R_4$ represents an alkyl group of 8 to 30 carbon atoms and T represents a —COO— group or a —CONH— group,

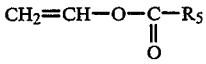

(4)

wherein $R_5$ represents an alkyl group of 8 to 30 carbon atoms.

4. A process for producing a liquid developer according to claim 1, wherein the polymer (S) having a mercapto group at its terminal is prepared by polymerizing the monomer represented by the above formula (3) or (4) or copolymerizing the monomers represented by the formulas (3) and (4) in the presence of a thiolacetic acid and treating the resulting polymer with ammonia or an amine.

5. A process for producing a liquid developer according to claim 1, wherein the polymer (S) having the chain transferable group on the side chain is prepared by copolymerizing a monomer represented by the following formula (5) or (6) with a monomer represented by the above formula (3) or (4),

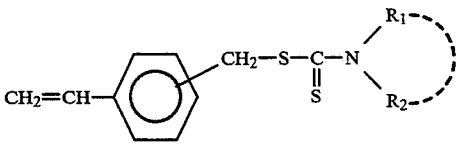

(5)

wherein $R_1$ and $R_2$ have the same meanings as defined in the formula (1),

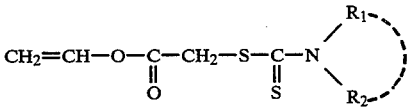

(6)

wherein $R_1$ and $R_2$ have the same meanings as defined in the formula (1).

6. A process according to claim 5, wherein the monomer represented by the formula (5) or (6) is used in an amount of 20% by weight or less of the monomer represented by the formula (3) or (4).

7. A process according to claim 5, wherein the monomer represented by the formula (5) or (6) is used in an amount of 1 to 10% by weight of the monomer represented by the formula (3) or (4).

8. A process for producing a liquid developer according to claim 1, wherein the polymer (S) have a molecular weight of 1000 to 500,000.

9. A process for producing a liquid developer according to claim 1, wherein the monomer (A) is selected from vinyl esters of aliphatic carboxylic acid of 1 to 6 carbon atoms; vinyl benzoate; acrylic acid, methacrylic acid, crotonic acid, maleic acid, itaconic acid and their alkyl esters of 1 to 6 carbon atoms and their amides; ethylene glycol di(meth)acrylate, methylenebisacrylamide, styrene and their derivatives; divinylbenzene; and N-containing vinyl monomers.

10. A process for producing a liquid developer for electrostatic photography which includes a highly insulating hydrocarbon medium and particle of a resin dispersed in said medium, wherein said resin is obtained by the following steps:

copolymerizing the following monomer (A) with the following monomer (B) the amount of the monomer (B) being 10% by weight or less based on the monomer (A), in the presence of the following polymer (S):

monomer (A)—a monomer which is soluble in said medium and becomes insoluble when copolymerized by the reaction at the chain transferable group part of the polymer (S) together with monomer (B) to become resin particles;

monomer (B)—a monomer which is copolymerized with the monomer (A) and which is soluble in the medium and forms a polymer soluble in the medium upon polymerization; and polymer (S)—a polymer which is for stably dispersing the resin particles formed by copolymerization of monomer (A) and monomer (B) in such a state that the polymer bonds to the resin particles and which is soluble in said medium and has a dithiocarbamate group represented by the following formula (1) or a mercapto group at the terminal or on the side chain thereof

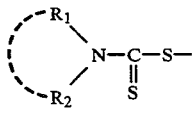

(1)

wherein $R_1$ represents an alkyl group of 1 to 8 carbon atoms, $R_2$ represents a hydrogen atom or an alkyl group of 1 to 8 carbon atoms, $R_1$ and $R_2$ may be identical or different and $R_1$ and $R_2$ may link to each other to form an alkylene group of 3 to 8 carbon atoms to form a ring together with N.

11. A process for producing a liquid developer according to claim 10, wherein the monomer (B) is selected from (meth)acrylate esters, (meth)acrylic acid amides, vinyl esters and vinyl ethers.

12. A process for producing a liquid developer according to claim 1 or 10, wherein the resin is obtained by polymerizing the monomer (A) or the monomers (A) and (B) in the presence of the polymer (S) using an oil-soluble initiator having a decomposition half-value period of 20 hours or less at 70° C. as a polymerization initiator at a polymerization initiating temperature of 70° C. or lower.

13. A process according to claim 12, wherein the polymerization initiating temperature is 50°–70° C.

14. A process according to claim 1 or 10, wherein the amount of the polymer (S) is 0.2–30% by weight based on the total amount of the monomers (A) and (B).

15. A process according to claim 1 or 10, wherein the amount of the polymer (S) is 2–15% by weight based on the total amount of the monomers (A) and (B).

* * * * *